United States Patent [19]

Fang et al.

[11] Patent Number: 4,907,340

[45] Date of Patent: Mar. 13, 1990

[54] ELECTRICAL DEVICE COMPRISING CONDUCTIVE POLYMERS

[75] Inventors: Shou-Mean Fang, Union City; Charles H. Camphouse, Mountain View, both of Calif.

[73] Assignee: Raychem Corporation, Menlo Park, Calif.

[21] Appl. No.: 102,987

[22] Filed: Sep. 30, 1987

[51] Int. Cl.[4] ..... H01C 17/00; H01B 1/04

[52] U.S. Cl. ..... 29/610.1; 219/504; 219/505; 219/528; 219/548; 219/549; 219/553; 338/22 R; 338/225

[58] Field of Search ..... 29/610, 611, 612, 610.1; 219/528, 549, 553, 548, 552, 504, 505; 252/511; 338/22 R, 22 SD, 23, 212

[56] References Cited

U.S. PATENT DOCUMENTS

| | | | |
|---|---|---|---|
| 3,243,753 | 3/1966 | Kohler et al. | 338/31 |
| 3,351,882 | 11/1967 | Kohler et al. | 338/322 |
| 3,861,029 | 1/1975 | Smith-Johannsen et al. | 29/611 |
| 4,177,376 | 12/1979 | Horsma et al. | 219/553 |
| 4,237,441 | 12/1980 | van Konynenburg et al. | 338/22 R |
| 4,238,812 | 12/1980 | Middleman et al. | 361/106 |
| 4,272,471 | 6/1981 | Walker | 264/104 |
| 4,286,376 | 9/1981 | Smith-Johannsen et al. | 29/611 |
| 4,317,027 | 2/1982 | Middleman et al. | 219/553 |
| 4,327,351 | 4/1982 | Walker | 338/22 R |
| 4,329,726 | 5/1982 | Middleman et al. | 361/58 |
| 4,330,703 | 5/1982 | Horsma et al. | 219/553 |
| 4,352,083 | 9/1982 | Middleman et al. | 338/23 |
| 4,388,607 | 6/1983 | Toy et al. | 219/553 |
| 4,400,614 | 8/1983 | Sopory | 29/611 |
| 4,413,301 | 11/1983 | Middleman et al. | 361/106 |
| 4,426,633 | 1/1984 | Taylor | 29/612 |
| 4,445,026 | 4/1984 | Walker | 219/553 |
| 4,481,498 | 11/1984 | McTavish et al. | 338/20 |
| 4,514,620 | 4/1985 | Cheng et al. | 338/22 R |
| 4,542,365 | 9/1985 | McTavish et al. | 338/20 |
| 4,543,474 | 9/1985 | Horsma et al. | 219/553 |
| 4,549,161 | 10/1985 | McTavish et al. | 338/20 |
| 4,654,511 | 3/1987 | Horsma et al. | 219/548 |
| 4,689,475 | 8/1987 | Matthiesen | 219/553 |
| 4,724,417 | 2/1988 | Au et al. | 338/22 SD |
| 4,743,321 | 5/1988 | Soni et al. | 219/535 |

FOREIGN PATENT DOCUMENTS

| | | |
|---|---|---|
| 0038713 | 4/1981 | European Pat. Off. . |
| 98647 | 1/1984 | European Pat. Off. . |
| 063440 | 6/1987 | European Pat. Off. . |
| 2434006 | 2/1976 | Fed. Rep. of Germany . |
| 2644256 | 3/1978 | Fed. Rep. of Germany . |
| 7623707 | 8/1976 | France . |
| 2528253 | 12/1983 | France . |

*Primary Examiner*—Bruce Y. Arnold
*Assistant Examiner*—R. D. Shafer
*Attorney, Agent, or Firm*—Marguerite E. Gerstner; Timothy H. P. Richardson; Herbert G. Burkard

[57] ABSTRACT

A process for preparing an electrical device which comprises a conductive polymer exhibiting PTC behavior. The device is irradiated by use of an electron beam at an average dose rate of less than 3.0 Mrad/minute. The cross-linking may be to a level of 50 to 100 Mrad or higher for devices designed to withstand high voltage test conditions. The device may be a laminar device comprising a center layer of higher resistivity than two surrounding layers.

4 Claims, 1 Drawing Sheet

ELECTRICAL DEVICE COMPRISING CONDUCTIVE POLYMERS

CROSS-REFERENCE TO RELATED APPLICATIONS

This application is related to copending U.S. application Ser. No. 103,077 (Fang et al) filed Sept. 30, 1987, the entire disclosure of which is incorporated herein by reference.

BACKGROUND OF THE INVENTION

1. Field of the Invention

This invention relates to electrical devices comprising conductive polymer compositions.

2. Introduction to the Invention

Conductive polymer compositions exhibiting PTC behavior, and electrical devices comprising them, are well known. Such electrical devices may comprise circuit protection devices, self-regulating strip heaters, or elongate cathodic protection devices. Reference may be made, for example, to U.S. Pat. Nos. 4,177,376, 4,330,703, 4,543,474 and 4,654,511 (Horsma, et al.), 4,237,441 (van Konynenburg, et al.), 4,238,812 and 4,329,726 (Middleman, et al.), 4,352,083 (Middleman, et al.), 4,317,027 (Middleman, et al.), 4,426,633 (Taylor), 3,351,882 (Kohler, et al.), 3,243,753 (Kohler), 4,689,475 (Matthiesen), 3,861,029 and 4,286,376 (Smith-Johannsen, et al.), French Patent Application No. 76 23707 (Moyer), and commonly assigned, copending applications, Ser. Nos. 141,989 (MP0715, Evans), 656,046 (MP0762, Jacobs, et al.), abandoned in favor of a file wrapper continuation Ser. No. 146,460 (filed Jan. 21, 1988) and published as European Patent Application No. 63,440 051,438 (MP0897-US5, Batliwalla, et al.) now U.S. Pat. No. 4,761,541 and 711,910 (MP1044, Au, et al.) now U.S. Pat. No. 4,724,417. The disclosure of each of the patents, publications, and applications referred to above is incorporated herein by reference.

Electrical devices with improved physical properties and improved electrical performance are achieved when the conductive polymer composition comprising the device is cross-linked. Such cross-linking can be accomplished through the use of chemical cross-linking agents or gamma or electron irradiation, or a combination of these. It is frequently true that ionizing irradiation generated by an electron beam results in the most rapid and cost-effective means of cross-linking.

SUMMARY OF THE INVENTION

We have discovered that one difficulty with this type of irradiation is the rapid temperature rise in the conductive polymer as a result of irradiation to high doses. An additional problem is that under these conditions, gases are generated during the cross-linking process more rapidly than they can be dissipated. This is particularly true for polymers that are irradiated to levels in excess of 50 or 100 Mrad, designed for use as circuit protection devices under conditions of high voltage. Such devices have been made with parallel columnar electrodes embedded in the conductive polymer matrix, rather than laminar metal foil or mesh electrodes attached to the surface of the conductive polymer element because of the delamination of the metal foil electrodes as a result of the gases generated. For instance, U.S. Ser. No. 656,046 now abandoned in favor of a file wrapper continuation Ser. No. 146,460, teaches that it is necessary to irradiate a laminar conductive polymer element before the laminar electrodes are attached to form a device. For devices comprising embedded columnar electrodes, rapid heating and generation of gases during irradiation may result in the formation of voids at the polymer/electrode interface, producing contact resistance and sites for electrical failure during operation at high voltages.

In order to efficiently and cheaply manufacture electrical devices it is desirable that laminar metal foil electrodes be attached prior to irradiation and that devices with columnar electrodes do not suffer from void-formation at the polymer/electrode interface as a result of rapid gas generation. It is also desirable that a laminar device be capable of withstanding relatively high voltages and currents without delamination of the laminar electrodes. We have found that electrical devices with improved performance can be produced if the conductive polymer element is maintained at a low temperature during the irradiation process.

Accordingly, in its first aspect, this invention provides a process for the preparation of an electrical device comprising (1) a PTC element composed of a cross-linked conductive polymer composition which exhibits PTC behavior and which comprises a polymeric component and, dispersed in the polymeric component, a particulate conductive filler; and (2) two electrodes which are electrically connected to the PTC element and which are connectable to a source of electrical power to cause current to pass through the PTC element, which process comprises subjecting the PTC element to radiation cross-linking in which (i) said cross-linking is achieved by use of an electron beam and (ii) the average dose rate is at most 3.0 Mrad/minute.

In another aspect, this invention provides a process for the preparation of an electrical device which comprises (1) a PTC element composed of a cross-linked conductive polymer composition which exhibits PTC behavior and which comprises a polymeric component and, dispersed in the polymeric component, a particulate conductive filler; and (2) two electrodes which are electrically connected to the PTC element and which are connectable to a source of electrical power to cause current to pass through the PTC element, which process comprises subjecting the PTC element to radiation cross-linking in which (i) said cross-linking is achieved by use of an electron beam;

(ii) said cross-linking is conducted such that the radiation dose absorbed by each current-carrying part of the PTC element is at least 50 Mrad; and (iii) during the cross-linking process, no part of the PTC element which is in contact with the electrodes reaches a temperature greater than (Tm - 60) °C., where Tm is the temperature measured at the peak of the endothermic curve generated by a differential scanning calorimeter for the lowest melting polymer in the polymeric component.

We have also discovered that improved laminar electrical devices comprise (1) a laminar PTC element; and (2) two laminar equidistant electrodes which are adjacent to and in electrical contact with said laminar PTC element; said PTC element comprising (a) a first layer which is composed of a first conductive polymer composition,
(b) a second layer which is composed of a second conductive polymer composition, and
(c) a third layer which is composed of a third conductive polymer composition;

and in which the first, second and third layers are arranged so that all current paths between the electrodes pass sequentially through the first, second and third layers; the resistivity of the second composition at 23° C. is higher than the resistivity of the first composition at 23° C. and higher than the resistivity of the third composition at 23° C.; and each of the conductive polymer compositions comprises a polymeric component and, dispersed in the polymeric component, a particulate conductive filler; and at least one of the following conditions is present (i) each of the first and third compositions exhibits PTC behavior with a switching temperature which is within 15 degrees of the switching temperature of the second composition;
(ii) the average thickness of the second layer is less than 33% of the distance between the electrodes;
(iii) the resistivity of the second composition is less than 50 ohm-cm;
(iv) the resistance of the second layer is less than 100 ohms and;
(v) the resistivity of each of the first and third compositions at 23° C. is less than 0.1 times the resistivity of the second composition at 23° C.

BRIEF DESCRIPTION OF THE DRAWINGS

The invention is illustrated in the accompanying drawing in which.

DETAILED DESCRIPTION OF THE INVENTION

Figure 1:
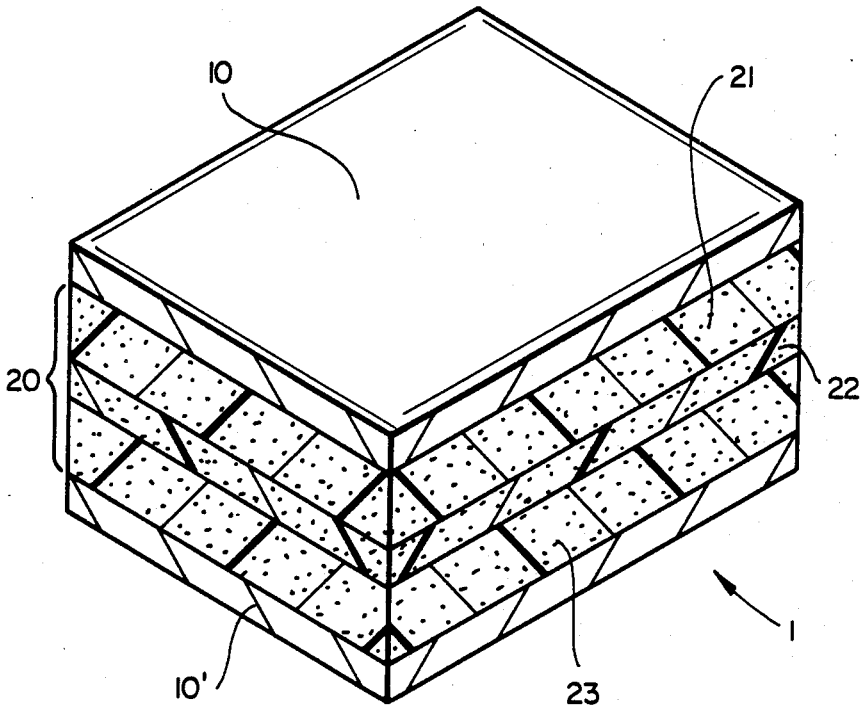
FIG. 1 shows an electrical device of the invention in plan view.

The invention described herein concerns electrical devices comprising a conductive polymer element and processes for preparing such devices. The conductive polymer element is composed of a polymeric component and, dispersed in the polymeric component, a particulate conductive filler. The polymeric component is preferably a crystalline organic polymer or blend comprising at least one crystalline organic polymer, such term being used to include siloxanes. The polymeric component has a melting temperature which is defined as the temperature at the peak of the endothermic curve generated by a differential scanning calorimeter. If the polymeric component is a blend of polymers, the melting temperature is defined as the melting temperature of the lowest melting polymeric component. The conductive filler may be graphite, carbon black, metal, metal oxide, or a combination of these. The conductive polymer element may also comprise antioxidants, inert fillers, prorads, stabilizers, dispersing agents, or other components. Dispersion of the conductive filler and other components may be conducted by dry-blending, melt-processing or sintering. The resistivity of the conductive polymer is measured at 23° C. (i.e. room temperature).

The conductive polymer element exhibits PTC behavior with a switching temperature, Ts, defined as the temperature at the intersection of the lines drawn tangent to the relatively flat portion of the log resistivity vs. temperature curve below the melting point and the steep portion of the curve. Suitable compositions are disclosed in the references cited. If the PTC element comprises more than one layer, and one or more of the layers is made of a polymeric composition that does not exhibit PTC behavior the composite layers of the element must exhibit PTC behavior.

The electrical device has two electrodes which are electrically connected to the PTC element and which are connectable to a source of electrical power to cause current to pass through the PTC element. The electrodes may be parallel columnar wires embedded within the conductive polymer or laminar electrodes comprised of metal foil or mesh and attached to the surface of the PTC element. Particularly preferred are metal foil electrodes of nickel or copper with an electrodeposited layer that has a microrough surface.

The electrical device may be cross-linked by the use of a chemical cross-linking agent or a source of ionizing radiation, such as a cobalt source or an electron beam. Electron beams are particularly preferred for efficiency, speed, and cost of irradiation. The devices may be irradiated to any level, although for devices intended for use in high voltage applications, doses of 50 to 100 Mrad or more (e.g. to 150 Mrad) are preferred. The irradiation may be conducted in one step or in more than one step; each irradiation segment may be separated by a heat-treatment step in which the PTC element is heated to a temperature above the melting point of the polymeric component and is then cooled to recrystallize the polymeric component. The cross-linking process may be conducted with or without the electrodes attached to the PTC element. The radiation dose is defined as the minimum amount of radiation dose absorbed by each current-carrying part of the PTC element. In the case of laminar electrical devices in which the current flows in a direction normal to the plane of the laminar electrode (i.e. through the thickness of the PTC element), the entire PTC element must be irradiated to the minimum dose. For devices with embedded columnar electrodes, the center of the PTC element, between and parallel to the electrodes, must be irradiated to the minimum dose.

It is preferred that during the irradiation step, the temperature of no part of the PTC element which is in contact with the electrodes reaches a temperature greater than (Tm - 60)° C., particularly (Tm - 80)° C. In the case of devices composed of high density polyethylene which has a Tm of about 130° C., it is preferred that the temperature remain less than 60° C., particularly less than 50° C., especially less than 40° C. In the case of an electron beam, this may be accomplished by cooling the devices through the use of fans or gas, or positioning the devices next to objects with large heat-sinking capabilities. Alteratively, maintaining a low temperature may be achieved through the use of a low electron beam current in which the average dose rate is at most 3.0 Mrad/minute. This value can be calculated based on the intensity of the electron beam and the pass rate of the devices through the beam path by taking the value at half-height of the bell curve of instantaneous dose rate plotted as a function of position of the devices in the beam path. It has been observed that if the device remains cool during the irradiation process the rate of gas generation (i.e. hydrogen from the cross-linking step) is balanced by the rate of diffusion of the gas from the device and few, if any, bubbles are observed at the interface of the PTC element and the electrodes. The result is that, in the case of laminar devices, the laminar electrodes do not delaminate, and with embedded columnar electrodes, the number and frequency of bubbles or voids at the polymer/electrode interface is limited. This results in improved electrical performance during application of electrical current.

Laminar electrical devices of the invention may comprise PTC elements which comprise three or more layers of conductive polymer. The layers may have the same or a different polymeric component or the same or a different conductive filler. Particularly preferred are devices with first, second and third layers arranged so that all current paths between the electrodes pass sequentially through the first, second and third layers. It is desirable that the second layer, which is sandwiched between the first and third layers, is the site of the hotline which is formed when the device is exposed to an electrical current. This can be achieved by the use of a second layer which has a room temperature resistivity higher than that of both the first and the third layers. During operation, through $I^2R$ heating, heat will be generated at the site of the highest resistance; this process will be enhanced by the limited thermal dissipation of the center region (second layer) of the device with respect to the top or bottom regions (first or third layers). If the hot line is controlled at the center of the device, it will not form at the electrodes, eliminating one failure mechanism common to laminar devices.

The resistivity of the three layers can be varied in several ways. The polymeric component of the layers may be the same, but the volume loading of conductive filler can be different for the second layer. In most cases, a higher resistivity is achieved by the use of either a lower volume loading of conductive filler or the same loading of a conductive filler with a lower electrical conductivity than the filler of the first layer. In some cases, a higher resistivity can be achieved by the use of the same volume loading of conductive filler but a lower loading of a non-conductive filler. It has been found that when the conductive filler is carbon black, useful compositions can be achieved when the polymeric component is the same for the layers, but the carbon black loading of the second layer is at least 2, preferably at least 3, especially at least 4 volume percent lower than that of the first or third layers. The resistivity of the second layer is preferably at least 20 percent, particularly at least two times, especially at least five times higher than the resistivity of the first and third layers. A PTC element made from the three layers may have a second layer with a resistivity of less than 50 ohm-cm or a resistance of less than 100 ohms. In another embodiment, the resistivity of the first layer and the third layer is less than 0.1 times the resistivity of the second layer.

Layered devices have been disclosed in the art for constructions of PTC and ZTC materials which differ in resistivity by at least one order of magnitude. It has been found that useful laminar devices can be made where all three layers exhibit PTC behavior if the switching temperature, Ts, of each of the layers is within 15° C. of the switching temperature of the second layer. It is preferred that Ts be the same for all three layers; this can be achieved by the use of the same polymeric component in the conductive polymer composition for each layer.

Useful layered laminar devices with hotline control can also be made when the second layer comprises less than one-third, preferably less than one-fourth, particularly less than one-fifth of the total thickness of the first, second and third layers. Preferred devices have a total thickness of at least 0.060 inch, particularly at least 0.100 inch. They have a resistance of less than 100 ohms. Such devices are useful for circuit protection applications where the applied voltage is 120 V or greater, particularly when they have been exposed to irradiation to a level of more than 50 Mrad.

Referring now to the FIGURE, FIG. 1 shows an electrical device (specifically a circuit protection device) 1 which has two laminar metal electrodes 10,10' attached to a PTC element 20. The PTC element is composed of a first conductive polymer layer 21 and a third conductive polymer layer 23 sandwiching a second conductive polymer layer 22.

The invention is illustrated in the following Examples, in which Example 1 is a comparative Example.

Example 1 (Comparative Example):

Conductive compounds A to D as listed in Table 1 were prepared using a Banbury mixer; each was pelletized. Equal quantities of Compounds A and B were blended together; the blend (Compound I) was extruded into a sheet with a thickness of 0.010 inch (0.025 cm). Equal quantities of Compounds C and D were blended together and the blend (Compound II) was extruded into a sheet with a thickness of 0.020 inch (0.050 cm). A laminated plaque was made by stacking 5 layers of 12×12 inch (30.5×30.5 cm) sheets of Compound I on either side of a single 12×12 inch sheet of Compound II and attaching 12×12×0.0014 inch (0.0036 cm) electrodeposited nickel foil electrodes (available from Fukuda) to the top and bottom surfaces by pressing at 175° C. and cooling under pressure. Devices were prepared by cutting 0.250×0.250 inch (0.635×0.635 cm) chips from the plaque. These were processed by heating at 150° C. for one hour, irradiating with a 2.5 MeV electron beam with a beam current of 10 mA to a dose of 25 Mrad, vacuum drying at 50° C. for 72 hours, heating a second time, irradiating under the same conditions to 150 Mrad (during which the devices reached a surface temperature of 70° C.), vacuum drying a second time, and heating a third time.

When the finished devices were powered under 250 VAC/2A conditions, the foil electrodes immediately delaminated.

TABLE I

Formulations of Compounds by Volume Percent

| Material | Cpd A | Cpd B | Cpd I | Cpd C | Cpd D | Cpd II |
|---|---|---|---|---|---|---|
| Marlex HXM 50100 | 54.1 | 52.1 | 53.1 | 57.1 | 55.1 | 56.1 |
| Statex G | 28.7 | 30.7 | 29.7 | 25.7 | 27.7 | 26.7 |
| Kisuma 5A | 15.5 | 15.5 | 15.5 | 15.5 | 15.5 | 15.5 |
| Antioxidant | 1.7 | 1.7 | 1.7 | 1.7 | 1.7 | 1.7 |

Marlex HXM 50100 is a high density polyethylene available from Phillips Petroleum.

Statex G is a carbon black available from Columbian Chemicals.

Kisuma 5A is a magnesium hydroxide available from Mitsui.

Antioxidant is an oligomer of 4,4'-thiobis (3-methyl-6-t-butyl phenol) with an average degree of polymerisation of 3-4, as described in U.S. Pat. No. 3,986,981.

Example 2:

Devices were prepared by the procedure of Example 1 except that the second irradiation step was conducted with a 2.5 MeV electron beam with a beam current of 2 mA and the devices reached a surface temperature of about 35° C. All of these devices survived 60 cycles at 250 VAC/2A and 60% of them survived 60 cycles at 600 VAC/1A.

We claim:

1. A process for the preparation of an electrical device which comprises (1) a PTC element composed of a cross-linked conductive polymer composition which exhibits PTC behavior and which comprises a polymeric component and, dispersed in the polymeric component, a particulate conductive filler; and (2) two electrodes which are electrically connected to the PTC element and which are connectable to a source of electrical power to cause current to pass through the PTC element, which process comprises subjecting the PTC element to radiation cross-linking in which (i) said cross-linking is achieved by use of an electron beam and (ii) the average dose rate is at most 3.0 Mrad/minute.

2. A process according to claim 1 wherein said cross-linking is conducted to a dose of at least 50 Mrad.

3. A process according to claim 1 wherein said cross-linking is conducted to a dose of at least 100 Mrad.

4. A process according to claim 1 wherein said cross-linking is conducted in two steps, said steps being separated by a heat-treatment process wherein said PTC element is heated to a temperature above the melting temperature of the polymeric component and is then cooled to recrystallize the polymer.

* * * * *